US008695713B2

(12) United States Patent
June et al.

(10) Patent No.: US 8,695,713 B2
(45) **Date of Patent: *Apr. 15, 2014**

(54) FUNCTION SPOOL

(71) Applicant: Cameron International Corporation, Houston, TX (US)

(72) Inventors: David R. June, Houston, TX (US); David R. Gwyn, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/895,561

(22) Filed: May 16, 2013

(65) Prior Publication Data

US 2013/0248200 A1 Sep. 26, 2013

Related U.S. Application Data

(63) Continuation of application No. 12/746,287, filed as application No. PCT/US2008/086627 on Dec. 12, 2008, now Pat. No. 8,443,899.

(60) Provisional application No. 61/013,203, filed on Dec. 12, 2007.

(51) Int. Cl.
*E21B 19/00* (2006.01)

(52) U.S. Cl.
USPC ..... 166/368; 166/382; 166/85.1

(58) Field of Classification Search
USPC ..... 166/348, 368, 382, 85.1, 88.1
See application file for complete search history.

(56) References Cited

U.S. PATENT DOCUMENTS

| | | | | |
|---|---|---|---|---|
| 4,491,176 | A | 1/1985 | Reed | |
| 4,607,691 | A | 8/1986 | Bridges | |
| 5,465,794 | A | 11/1995 | McConaughy et al. | |
| 5,544,707 | A | 8/1996 | Hopper et al. | |
| 5,749,608 | A | 5/1998 | Wilkins et al. | |
| 6,062,314 | A * | 5/2000 | Nobileau | 166/368 |
| 6,082,460 | A | 7/2000 | June | |
| 6,158,716 | A | 12/2000 | Wilkins et al. | |
| 6,227,300 | B1 | 5/2001 | Cunningham et al. | |
| 6,942,028 | B2 | 9/2005 | Hosie | |
| 7,121,346 | B2 | 10/2006 | Wolff et al. | |
| 8,322,441 | B2 * | 12/2012 | Fenton | 166/368 |
| 8,443,899 | B2 * | 5/2013 | June et al. | 166/368 |
| 2008/0017383 | A1 | 1/2008 | Minassian et al. | |
| 2009/0000781 | A1 | 1/2009 | Bolding | |

OTHER PUBLICATIONS

PCT International Search Report dated Jul. 23, 2009 for PCT Application No. PCT/US2008/086627, filed Dec. 12, 2008.
International Preliminary Report on Patentability dated Jun. 24, 2010 for PCT Application No. PCT/US2008/086627, filed Dec. 12, 2008.

* cited by examiner

*Primary Examiner* — William P Neuder
(74) *Attorney, Agent, or Firm* — Chamberlain Hrdlicka

(57) ABSTRACT

A production assembly and method for controlling production from production tubing supported by a tubing hanger in a well including a wellhead. The assembly includes a function spool engaged with the wellhead and a tree engaged with the function spool. The tubing hanger is landable in the tree bore such that the production tubing is supported in the well by the tree. A function mandrel separate from the tubing hanger is engaged with the production tubing and positionable inside the function spool bore. The function mandrel includes a passage connected to a line extending into the well that is connectable with a port in the function spool such that communication with a downhole component through the line is allowable from outside the function spool.

20 Claims, 2 Drawing Sheets

FUNCTION SPOOL

STATEMENT REGARDING FEDERALLY SPONSORED RESEARCH OR DEVELOPMENT

Not Applicable.

BACKGROUND

A well capable of producing oil or gas will typically have a well structure to provide support for the borehole and isolation capabilities for different formations. Typically, the well structure includes an outer structure such as a conductor housing at the surface that is secured to conductor pipe that extends a short depth into the well. A wellhead housing is landed in the conductor housing with an outer or first string of casing extending from the wellhead and through the conductor to a deeper depth into the well. Depending on the particular conditions of the geological strata above the target zone (typically, either an oil or gas producing zone or a fluid injection zone), one or more additional casing strings will extend through the outer string of casing to increasing depths until the well is cased to its final depth. Each string of casing is supported at the upper end by a casing hanger that lands in and is supported by the wellhead housing, each set above the previous one. Between each casing hanger and the wellhead housing, a casing hanger seal assembly is set to isolate each annular space between strings of casing. The last, and innermost, string of casing extends into the well to the final depth and is referred to as the production casing. The strings of casing between the outer casing and the production casing are typically referred to as intermediate casing strings.

When drilling and running strings of casing in the well, it is critical that the operator maintain pressure control of the well. This is accomplished by establishing a column of fluid with predetermined fluid density inside the well that is circulated down into the well through the inside of the drill string and back up the annulus around the drill string to the surface. This column of density-controlled fluid balances the downhole pressure in the well. A blowout preventer system (BOP) is also used to as a safety system to ensure that the operator maintains pressure control of the well. The BOP is located above the wellhead housing and is capable of shutting in the pressure of the well, such as in an emergency pressure control situation.

After drilling and installation of the casing strings, the well is completed for production by installing a string of production tubing that extends to the producing zone within the production casing. The production tubing is supported by a tubing hanger assembly that lands and locks above the production casing hanger. Perforations are made in the production casing to allow fluids to flow from the formation into the productions casing at the producing zone. At some point above the producing zone, a packer seals the space between the production casing and the production tubing to ensure that the well fluids flow through the production tubing to the surface.

Various arrangements of production control valves are arranged at the wellhead in an assembly generally known as a tree, which is generally either a vertical tree or a horizontal tree. A horizontal tree arranges the production control valves offset from the production tubing and one type of horizontal tree is a Spool Tree™ shown and described in U.S. Pat. No. 5,544,707, hereby incorporated herein by reference for all purposes. A horizontal tree locks and seals onto the wellhead housing but instead of being located in the wellhead, the tubing hanger locks and seals in the tree bore itself. After the tree is installed, the tubing string and tubing hanger are run into the tree using a tubing hanger running tool (THRT) and a locking mechanism locks the tubing hanger in place in the tree. The production port extends through the tubing hanger and seals prevent fluid leakage as production fluid flows into the corresponding production port in the tree.

The tubing hanger typically has a plurality of auxiliary passages that surround the vertical bore associated with the production tubing. The auxiliary passages provide penetration access through the tubing hanger from outside the tree for hydraulic, optical, and electrical components located downhole. Electrical, optical, and hydraulic lines extend downhole alongside the tubing to control and/or power downhole valves such as a surface-controlled subsurface safety valve (SC-SSV), temperature sensors, electric submersible pumps (ESP), downhole processors, and the like, as well as possibly provide for chemical reagent injection. Other types of lines than those listed may also be extended downhole. As the tubing hanger is landed and set in the tree, the auxiliary passages in the tubing hanger typically wet mate with auxiliary connectors located in the tree itself that may lead to a control unit mounted to the tree assembly.

A disadvantage of the conventional type of subsea wellhead assembly is that the tubing hanger must be large enough to house the number of passages extending through it. In addition to housing the passages, the tubing hanger requires a certain amount of structural integrity to support the production tubing. Thus there are only so many auxiliary passages that may be included in a given size tubing hanger before the tubing hanger needs to be enlarged. A large diameter tubing hanger also requires a large diameter drilling riser and BOP through which the tubing hanger must be run prior to installing the tree. Additionally, if the tubing hanger is made longer, the tree must also be lengthened, resulting in additional costs and weight for both items.

Another disadvantage of the auxiliary passages is that different wells may require different functions. Thus, trees must be "customized" to meet the needs of the particular well. Whereas certain downhole functionality may be common among many wells, other types of functionality may be more optional. Building a "one-size-fits-all" tubing hanger/tree thus would be inefficient because unwanted functionality built into the tree/tubing hanger adds unnecessary size, weight, and cost to the completion. Manufacturing costs alone would cause inefficiencies because of the added complexity and labor of manufacturing auxiliary ports into a solid tree body.

Another concern is that the downhole functionality needs of any given well may change over the life of the well. Specifically, a well may produce fluids at high pressure during the initial life of the well, but the pressure may taper off in the later part. With the initial higher production, the tree needs to be able to handle pressure as high as 15,000 psi. With such a high pressure, there is usually little need to install an ESP or engineer the capability of powering and controlling the ESP through the tubing hanger because the fluid pressure is adequate for fluid production. However, the pressure may taper off to as low as 5,000 psi during the life of the well and may require the use of an ESP. If so, the entire tree and completion may need to be pulled and replaced to add the ESP capability, thus costing the well operator valuable time and money. The initial tree could be designed for ESP functionality, but would result in a higher initial cost of the tree itself.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
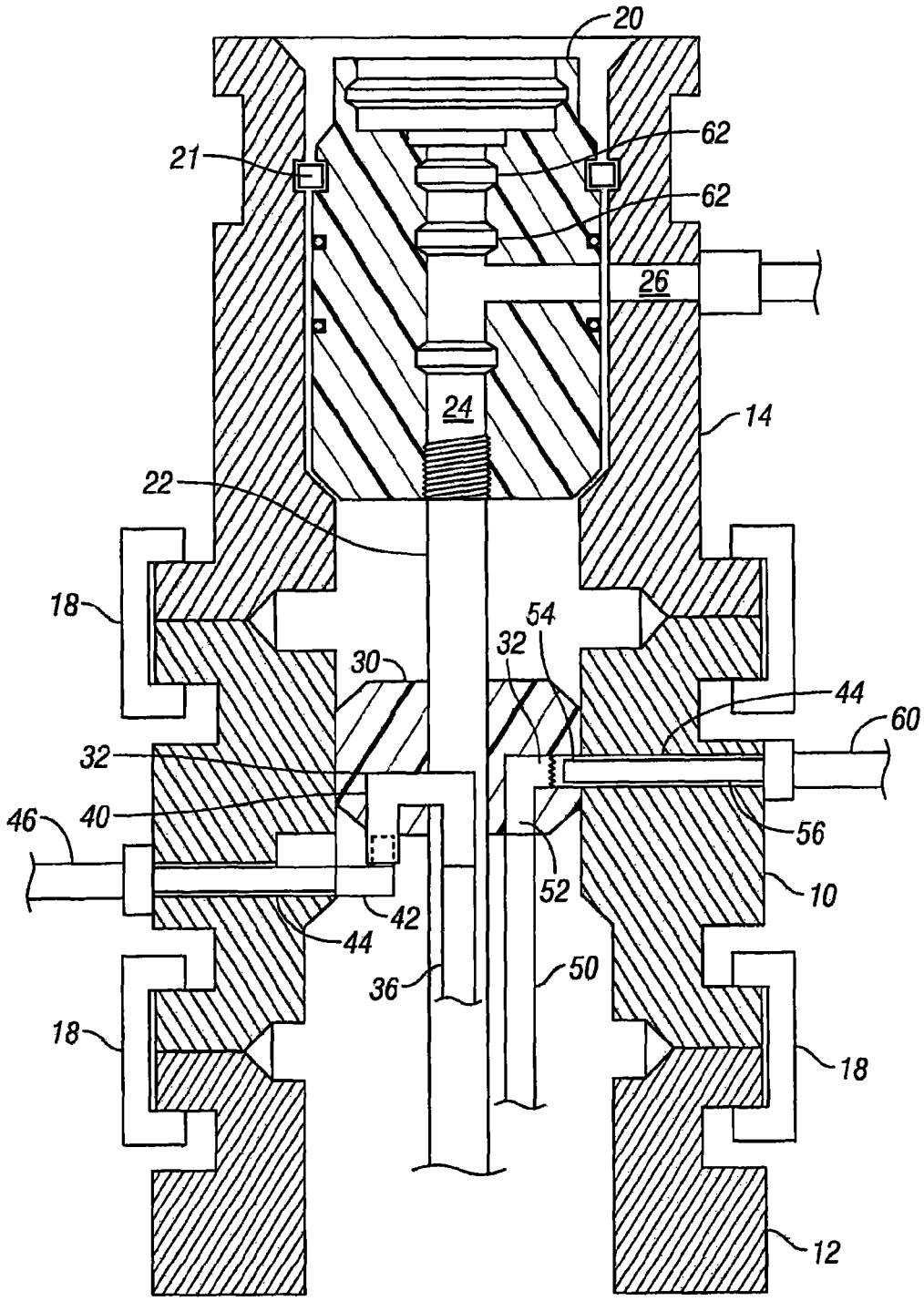
FIG. 1 is an embodiment of a function spool installed on a well.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 illustrates an embodiment of a function spool 10 mounted onto a subsea wellhead 12. Mounted on the function spool 10 opposite the wellhead 12, FIG. 1 also shows a horizontal tree 14. When the well is drilled and ready for completion, the function spool 10 and the horizontal tree 14 are lowered and installed onto the wellhead 12 using hydraulically operated collet connectors 18, with seals being formed by appropriate gaskets as shown. Although not shown, appropriate valves for controlling fluid production from the horizontal tree 14 are located in or attached to the horizontal tree 14. Additionally, any suitable connectors may be used instead of the collet connectors 18. For example, the function spool 10 and horizontal tree 14 may be attached using a bolted flange.

When the well is ready for completion, appropriate plugs are set downhole from the wellhead 12 to maintain fluid pressure. The blowout preventer (BOP) and riser are then removed from the wellhead 12 and the function spool 10 and horizontal tree 14 are installed either in separate sections or both sections at the same time. The BOP and riser are then reattached to the horizontal tree 14 and the plugs removed from the well using an appropriate tool run in through the riser. When installed, the function spool 10 and horizontal tree 14 may then be pressure tested to confirm pressure integrity.

A tubing hanger running tool (THRT) is then used to lower a completion, including a tubing hanger 20 and a string of production tubing 22, through the riser and land the tubing hanger 20 in the horizontal tree 14. When landed, the THRT actuates a lock ring 21 at the top of the tubing hanger 20 that engages the horizontal tree 14 and locks the tubing hanger 20 in place. It should be noted though that any locking assembly may be used, such as expandable dogs that engage a corresponding profile in the horizontal tree 14. The production tubing 22 extends below the tubing hanger 20 into the well and the tubing hanger 20 includes an internal bore 24 aligned on one end with the bore of the production tubing 22. The other end of the internal bore 24 exits the tubing hanger 20 in alignment with a master production port 26 in the horizontal tree 14 for producing well fluids to the surface. Although not shown, the completion includes a rotational alignment means that aligns the tubing hanger 20 with the horizontal tree 14 for aligning the internal bore 24 with the production port 26 as the tubing hanger 20 is lowered into the set position.

The completion also includes a function mandrel 30 extending from the production tubing 22 below the tubing hanger 20. As shown, the function mandrel 30 surrounds the production tubing 22 and is held in place by any suitable connection with the production tubing 22, such as a threaded connection or welding. Instead of being housed in the tubing hanger 20, the auxiliary function passages are located in the function mandrel 30 to interact with the function spool 10. Such auxiliary function passages may be located in any position in the function mandrel 30 and may include passages 32 for electrical, optical, and hydraulic lines that extend downhole alongside the production tubing 22 to control and/or power downhole valves such as a surface-controlled subsurface safety valve (SCSSV), temperature sensors, downhole electric submersible pumps (ESP), downhole processors, and the like, as well as possibly provide for chemical reagent injection. Other types of lines than those listed may also extend downhole from the function mandrel 30.

Corresponding to the functional passages 32 are ports 44 in the function spool 10 that provide access to the function passages 32 from outside the tree for controlling and/or powering the components located downhole. The auxiliary passages 32 typically house connectors that passively wet mate with auxiliary port connectors located in the function spool 10 and may take any suitable form, including vertical or horizontal connectors. The ports 44 in the function spool 10 also include connectors and may also lead to a control unit located subsea or on the surface. Additionally, although the tubing hanger 20 may interact with the horizontal tree 14 to align the radial angle of the tubing hanger 20 and thus the function mandrel 30, the connection of the function mandrel 30 to the production tubing 22 may be designed to allow a certain amount of function mandrel 30 vertical and rotational movement. The ability of the function mandrel 30 to move allows for a certain amount of tolerance should the connectors not be perfectly aligned when the tubing hanger 20 is in the set position.

As an example, the function spool 10 includes an auxiliary passage 32 for housing a hydraulic fluid line 36 that extends downhole to an SCSSV (not shown). The SCSSV controls the flow of fluid through the production tubing 22 from the producing zone. The fluid line 36 extends from the SCSSV and into the function mandrel 30 and routes into a passive coupler 40. Corresponding with the coupler 40 in the function mandrel 30, the function spool 10 includes a vertical coupler 42 that can extend from the function spool 10 into alignment with the function mandrel 30 coupler 40 for a vertical stab connection as shown. The stab connection forms a fluid tight connection when the tubing hanger 20 lands in the horizontal tree 14. From the coupler 42, a port 44 extends through the function spool 10 and is accessible from outside the function spool 10 by a hydraulic control line 46 that extends to the surface. When connected, the hydraulic control line 46 enables surface control of the SCSSV for well operations. Alternatively, line 36 may be an electrical line for powering a downhole electric submersible pump (ESP) (not shown).

Also shown in FIG. 1 is an example of another auxiliary passage 32 for housing an electrical line 50 for powering an ESP (not shown). The ESP is used to increase the fluid pressure for production fluids through the production tubing 22 from the producing zone. The electrical line 50 extends from the ESP and into the function mandrel 30 and routes into a passive coupler 52. Corresponding with the function mandrel 30 coupler 52 is a horizontal coupler 54 that can extend from the function spool 10 into engagement with the passive coupler 52 for a horizontal stabbing engagement as shown. The stab connection thus forms a fluid tight connection between the electrical line 50 and an electrical line 56 located in a port 44 that extends through the function spool 10 and is accessible from outside the function spool 10 by an electrical line 60 that extends to the surface. When connected, the electrical line 50 thus enables surface control of the ESP for well operations. Alternatively, line 50 may be a hydraulic line that extends downhole to an SCSSV (not shown).

The examples shown are simply two possible types of connections that may be made through auxiliary ports in the function mandrel 30 and accessible from the function spool 10. It should be appreciated that other types of connections may be made as well and that the connections shown in the examples may be used for different types of communication lines, such as for example, electrical, hydraulic, or optical. Additionally, there may be as many auxiliary ports as a given function mandrel 30 may allow. Because the function mandrel 30 is not being used to support the weight of the production tubing 22, the function mandrel 30 does not require the robust structural integrity of a support body.

With the completion set, the well is ready for production. To create a barrier to fluid from escaping the internal bore 24 through the top of the tubing hanger 20, plugs 62 are run into the internal bore 24 and set. The BOP and riser may then be removed from the horizontal tree 14 and retrieved. Using the hydraulic control line 36, hydraulic fluid may be used to open the downhole SCSSV and allow fluid production to flow from the production tubing 22, and into the production port 26 for flow to the surface or any other desired location.

At different times in the life of the well, the well may need additional or different downhole functionalities. For example, as already mentioned, fluid pressure may initially be adequate for fluid production but a downhole ESP may need to be added for production in the future. Additionally, various downhole sensors or processors may need to be added for ongoing production monitoring and management. With the function spool 10 and function mandrel 30, the horizontal tree 14 and the tubing hanger 20 need be designed for connecting and supporting the production tubing 22. The various functional connections are no longer made in the tubing hanger 20 but are instead made using passages in the function mandrel 30 and function spool 10. The well operators may thus change out the function mandrel 30 and function spool 10 on an as needed basis during the life of the well without having to purchase an entirely new horizontal tree 14, resulting in considerable cost savings. In addition, the horizontal tree 14 and tubing hanger 20 may be made smaller because they no longer need to house the functional connections, resulting in lower costs. Further cost savings result from a smaller horizontal tree 14 and tubing hanger 20 because of the increased mobility in particular of the horizontal tree 14 itself. With a smaller horizontal tree 14 and separate function spool 10, the horizontal tree 14 and function spool 10 may now be transported and installed on the wellhead 12 separately using lower capacity cranes without requiring as robust equipment as trees that house all of the functional connections. Further cost savings may also be achieved in manufacturing because instead of each horizontal tree 14 being customized for each well, one horizontal tree 14 may be made for a larger number of wells with the function spool 10 and function mandrel 30 may be customized instead.

An additional benefit also arises for wells that do not require any downhole functionality to be built into a function spool 10 during the initial production of a well. In those cases, no or minimal functionality may be built into the tubing hanger 20, such as control for an SCSSV, and the horizontal tree 14 may be installed on the wellhead 12 directly. Later in the life of the well, should additional downhole functionality be needed, the function spool 10 and function mandrel 30 may be added at that time, resulting in cost savings for the well operator from being able to continue using the original horizontal tree 14 and not having to install a full function tree for the initial production.

Figure 2:
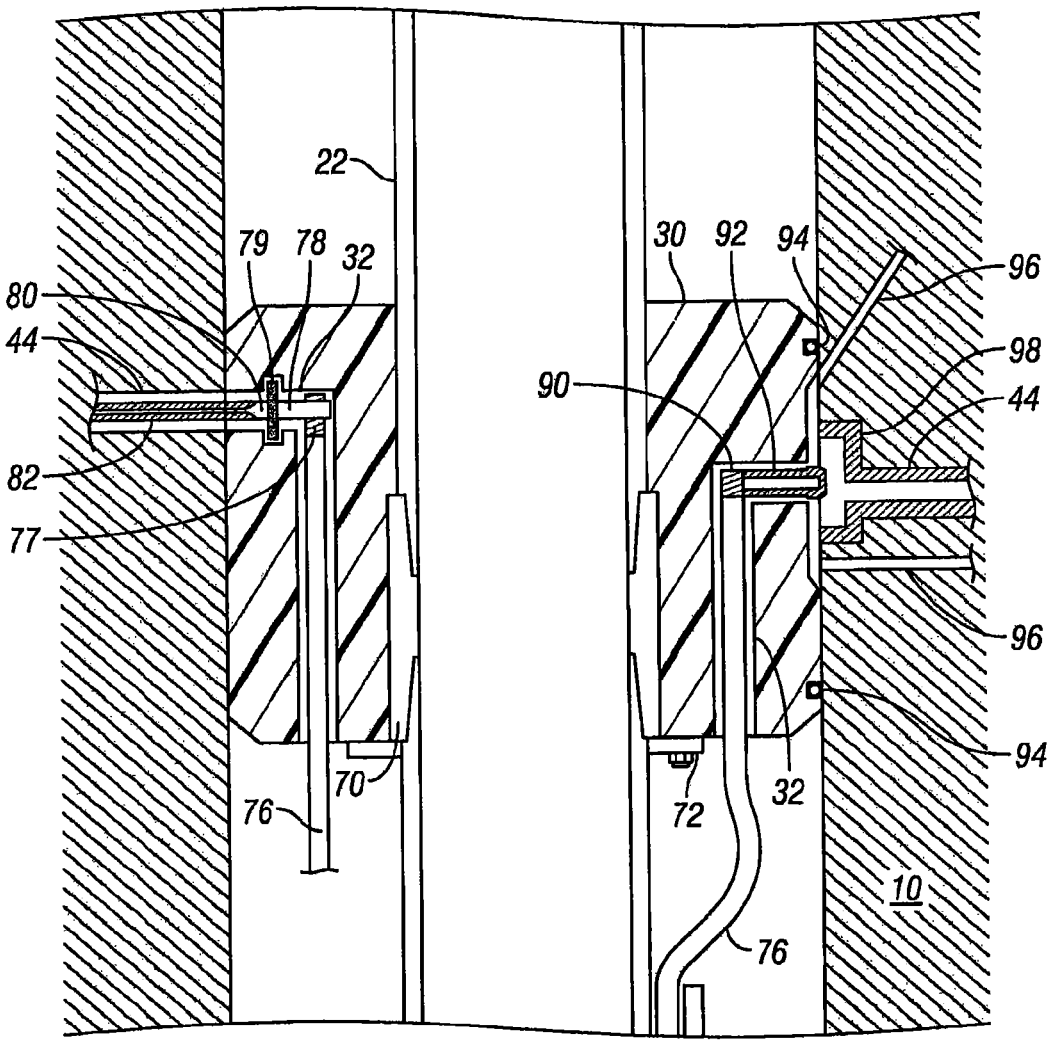
FIG. 2 shows example auxiliary port connections that may be used in the function spool.

Additional examples of connections through the function mandrel 30 are shown in FIG. 2 that shows the function mandrel 30 engaging a coupling collar 70 and held in place with a capture ring bolted to the bottom of the function mandrel 30. Extending into an auxiliary passage 32 is an electrical line 76 for powering and/or communicating with a downhole sensor (not shown), such as a pressure transducer. However, any downhole sensor may be suitable. The electrical line 76 extends from the sensor into the function mandrel 30 and ends with a threaded connector 77 that threads into a connector base 78. The connector base 78 is held in place by an insulated ring 79 and includes a pin contact 80. Corresponding with the connector, a power connector penetrator 82 is extendable from the function spool 10 into engagement with the pin contact 80 for a horizontal stabbing engagement as shown. The stab connection forms a fluid tight connection between the electrical line 76 and an electrical line in the port 44 that extends through the function spool 10 and is accessible from outside the function spool 10 by an electrical line that extends to the surface. When connected, the electrical line 76 thus enables power of and/or communication with a downhole electronic device, such as a downhole sensor.

FIG. 2 also shows another electrical line 76 for powering and/or communicating with any type of downhole electronic device (not shown), such as a downhole processor. The electrical line 76 extends from the electronic device and into a passage 32 of the function mandrel 30 and ends in a connector base 90. Extending from the connector base 90 is an electrical contact 92 that extends past a milled portion of the function mandrel 30. Seals 94 are located in the function mandrel 30 to isolate the milled portion of the function mandrel 30 from fluid pressure in the function spool 10 and flushing ports 96 in the function spool 10 are used to flush the fluid trapped in the milled portion out with appropriate electrical connection fluid. The electrical contact 92 extends into the milled portion and into electrical contact with a contact ring 98 to complete the electrical connection. The contact ring 98 provides a large enough area around the electrical contact 92 that exact placement of the electrical contact 92 with respect to the contact ring 98 is not necessary. Thus, the contact ring 98 does not require exact placement of the function mandrel 30 with respect to the function spool 10. Although not shown, an electrical line extends from the contact ring 98 in the port 44 that extends through the function spool 10 and is accessible from outside the function spool 10 by an electrical line that extends to the surface. When connected, the electrical line 76 thus enables power of and/or communication with a downhole electronic device, such as a downhole processor.

While specific embodiments have been shown and described, modifications can be made by one skilled in the art without departing from the spirit or teaching of this invention.

The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. An assembly for a subsea well including a well bore, comprising:

a wellhead assembly including a wellhead bore including a port extending through a sidewall of the wellhead assembly;

a production tree mountable on the wellhead assembly and including a tree bore alignable in line with the wellhead bore;

a tubing hanger to support a production tubing in the well bore; and a function mandrel positionable inside the wellhead bore and including a passage connectable with the wellhead assembly port to establish a communication path from outside the wellhead assembly.

2. The assembly of claim 1, wherein the wellhead assembly further includes a function spool mountable on a wellhead member, the well assembly port extending through a sidewall of the function spool.

3. The assembly of claim 1, further comprising a line extending from the function mandrel into the well to establish communication between the mandrel passage and a downhole component.

4. The assembly of claim 2, wherein the line includes an electrical, optical, or fluid line.

5. The assembly of claim 1, wherein the function mandrel surrounds the production tubing.

6. The assembly of claim 1, wherein the production tree is a horizontal tree.

7. The assembly of claim 1, wherein the function mandrel is separate from and spaced apart from the tubing hanger.

8. The assembly of claim 1, further including multiple function mandrel passages connectable with multiple wellhead assembly ports.

9. The assembly of claim 8, wherein the function mandrel may be replaced with a second function mandrel.

10. The assembly of claim 1, wherein the only passage through the tubing hanger is a production fluid passage.

11. The assembly of claim 1, wherein the function mandrel is movable at least one of axially along and rotationally with respect to the production tubing.

12. The assembly of claim 1, further including a pump locatable downhole in the well bore and wherein the wellhead port and function mandrel passage allow electrical communication to the pump from outside the wellhead assembly.

13. An assembly for a subsea well including a well bore, a wellhead assembly, a production tree, and a tubing hanger to support a production tubing, including:

a function spool mountable to the wellhead assembly and including a spool bore and a port extending through a sidewall of the function spool; and a function mandrel positionable inside the spool bore and including a passage connectable with the spool port to establish a communication path from outside the function spool.

14. The assembly of claim 13, further comprising a line extending from the function mandrel into the well to establish communication between the mandrel passage and a downhole component.

15. The assembly of claim 14, wherein the line includes an electrical, optical, or fluid line.

16. The assembly of claim 13, wherein the function mandrel surrounds the production tubing.

17. The assembly of claim 13, wherein the function mandrel is separate from and spaced apart from the tubing hanger.

18. The assembly of claim 13, further including multiple function mandrel passages connectable with multiple spool ports.

19. The assembly of claim 18, wherein the function mandrel may be replaced with a second function mandrel.

20. The assembly of claim 13, wherein the function mandrel is movable at least one of axially along and rotationally with respect to the production tubing.

* * * * *